US012722059B1

(12) United States Patent
Paeltz et al.

(10) Patent No.: US 12,722,059 B1
(45) Date of Patent: Sep. 1, 2026

(54) TRACKABLE GAMING BAG AND METHODS THEREOF

(71) Applicants: Earl Coy Paeltz, Cincinnati, OH (US); Robert Edgar Estes, Jr., Cincinnati, OH (US)

(72) Inventors: Earl Coy Paeltz, Cincinnati, OH (US); Robert Edgar Estes, Jr., Cincinnati, OH (US)

( * ) Notice: Subject to any disclaimer, the term of this patent is extended or adjusted under 35 U.S.C. 154(b) by 829 days.

(21) Appl. No.: 18/171,787

(22) Filed: Feb. 21, 2023

Related U.S. Application Data

(60) Provisional application No. 63/312,130, filed on Feb. 21, 2022.

(51) Int. Cl.

| | |
|---|---|
| ***A63B 67/06*** | (2006.01) |
| ***A63B 24/00*** | (2006.01) |
| ***A63B 71/06*** | (2006.01) |

(52) U.S. Cl.
CPC ..... *A63B 67/06* (2013.01); *A63B 24/0021* (2013.01); *A63B 71/0622* (2013.01); *A63B 2024/0034* (2013.01); *A63B 71/0669* (2013.01); *A63B 2220/05* (2013.01); *A63B 2220/35* (2013.01); *A63B 2220/806* (2013.01); *A63B 2220/833* (2013.01); *A63B 2225/50* (2013.01)

(58) Field of Classification Search
CPC . A63B 67/06; A63B 24/0021; A63B 71/0622; A63B 71/0669; A63B 2024/0034; A63B 2220/05; A63B 2220/35; A63B 2220/806; A63B 2220/833; A63B 2225/50
See application file for complete search history.

(56) References Cited

U.S. PATENT DOCUMENTS

| | | | | |
|---|---|---|---|---|
| 2010/0317470 | A1* | 12/2010 | Cea | A63B 67/06 473/570 |
| 2014/0091525 | A1* | 4/2014 | Ramirez | A63B 63/08 273/402 |
| 2015/0343287 | A1* | 12/2015 | Stover | A63B 69/0002 473/458 |
| 2021/0308550 | A1* | 10/2021 | Li | A63B 71/0622 |
| 2022/0096909 | A1* | 3/2022 | Russell | H05B 47/13 |

* cited by examiner

*Primary Examiner* — Jeffrey S Vanderveen
(74) *Attorney, Agent, or Firm* — FBT Gibbons LLP

(57) ABSTRACT

Systems and methods are disclosed for tracking variables associated with the throwing of a tossable gaming bag, such cornhole gaming bags. A flight data collection system associated with the gaming bag can track velocity, rotation, and height of the gaming bag during a toss. The tracked variables can be displayed on a graphical display.

18 Claims, 9 Drawing Sheets

TRACKABLE GAMING BAG AND METHODS THEREOF

CROSS-REFERENCE TO RELATED APPLICATIONS

This application claims the benefit of U.S. provisional patent application No. 63/312,130, filed on Feb. 21, 2022 and titled TRACKABLE GAMING BAG AND METHODS THEREOF, the disclosure of which is incorporated herein by reference in its entirety.

TECHNICAL FIELD

The present disclosure relates generally to a tossable gaming bag. More particularly, the invention relates to tracking variables associated with the throwing of a tossable gaming bag, such as velocity, rotation, and height using a flight data collection system.

BACKGROUND

Gaming bags come in a variety of shapes and sizes for a multitude of purposes. One of the more popular games that utilizes gaming bags is cornhole. Cornhole is generally played with two game boards and eight gaming bags. The gaming bags have two sets of distinctive colors or patterns, with four bags having each color or pattern. The cornhole board in generally rectangular in shape with a raised back end and a hole located proximate the back end. The cornhole board is arranged similar to a ramp so that the gaming bag can be slid towards the back end and still permit the bag to remain on the board after being thrown. Regulation cornhole boards are approximately two feet wide and four feet long, with the front end resting on the ground and the back end raised approximately twelve inches.

Cornhole is played in frames, where each player rotates throwing his or her gaming bag towards the target. After all eight bags have been thrown, the bags remaining on the cornhole board are scored as one point and any bags traversing the hole are scored as three points. The ultimate goal of the game is to be the first team to reach 21 points.

A player's skill level impacts their ability to accurately and consistently toss their gaming bag into the hole, or at least onto the board. While a player can train to play cornhole by simply repeatable tossing gaming bags towards the target, they do not necessarily receive any actionable feedback data to assist in their training. As such, there remains a need to provide players with analytic information regarding their gaming bag tosses.

BRIEF DESCRIPTION OF THE DRAWINGS

It is believed that certain embodiments will be better understood from the following description taken in conjunction with the accompanying drawings, in which like references indicate similar elements and in which.

DETAILED DESCRIPTION

Figure 1:
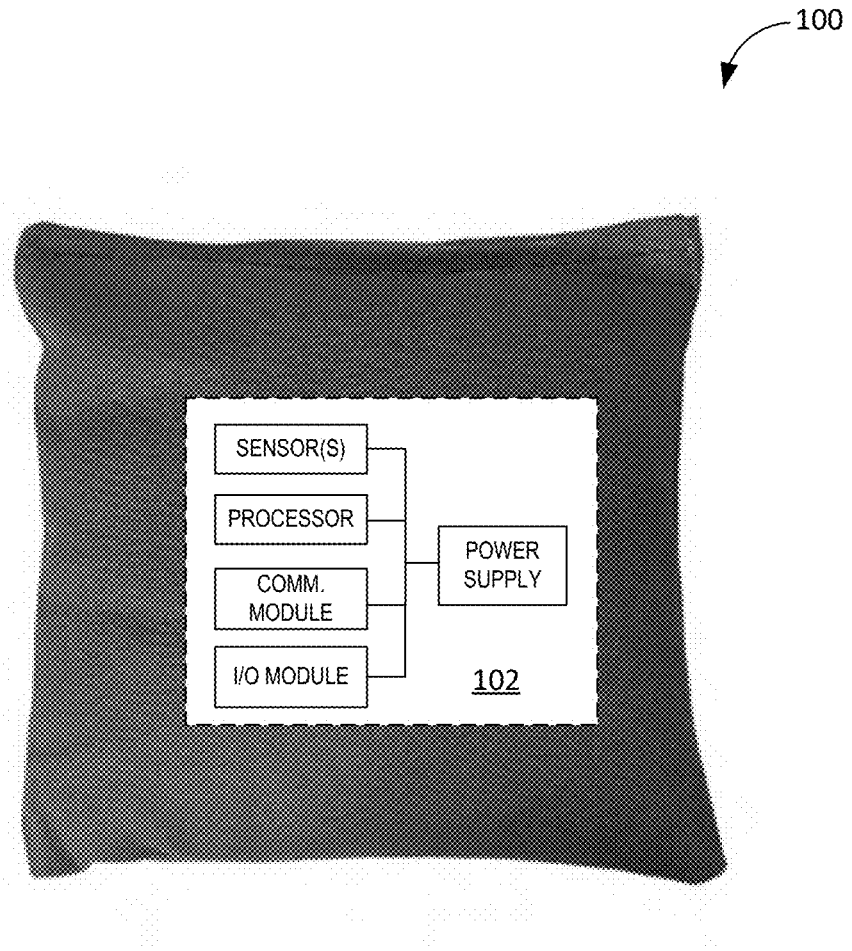
FIG. 1 depicts an example gaming bag having an onboard flight data collection system in accordance with one non-limiting embodiment.

Various non-limiting embodiments of the present disclosure will now be described to provide an overall understanding of the principles of the structure, function, and use of systems, apparatuses, devices, and methods disclosed. One or more examples of these non-limiting embodiments are illustrated in the selected examples disclosed and described in detail with reference made to FIGS. 1-12 in the accompanying drawings. Those of ordinary skill in the art will understand that systems, apparatuses, devices, and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

The systems, apparatuses, devices, and methods disclosed herein are described in detail by way of examples and with reference to the figures. The examples discussed herein are examples only and are provided to assist in the explanation of the apparatuses, devices, systems and methods described herein. None of the features or components shown in the drawings or discussed below should be taken as mandatory for any specific implementation of any of these apparatuses, devices, systems or methods unless specifically designated as mandatory. For ease of reading and clarity, certain components, modules, or methods may be described solely in connection with a specific figure. In this disclosure, any identification of specific techniques, arrangements, etc. are either related to a specific example presented or are merely a general description of such a technique, arrangement, etc. Identification of specific details or examples is not intended to be, and should not be, construed as mandatory or limiting unless specifically designated as such. Any failure to specifically describe a combination or sub-combination of components should not be understood as an indication that any combination or sub-combination is not possible. It will be appreciated that modifications to disclosed and described examples, arrangements, configurations, components, elements, apparatuses, devices, systems, methods, etc. can be made and may be desired for a specific application. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented, but instead may be performed in a different order or in parallel.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

Throughout this disclosure, references to components or modules generally refer to items that logically can be grouped together to perform a function or group of related functions. Like reference numerals are generally intended to refer to the same or similar components. Components and modules can be implemented in software, hardware, or a combination of software and hardware. The term "software" is used expansively to include not only executable code, for example machine-executable or machine-interpretable instructions, but also data structures, data stores and computing instructions stored in any suitable electronic format, including firmware, and embedded software.

As described in more detail below, the present disclosure generally relates to the tracking of gaming bag tosses. Such tracking can be used, for example, to allow a player to working on throwing mechanics, gaming bag control, aiming, and so forth for training purposes. In other embodiments, such tracking can be used, for example, to generate real-time flight analytics that can be displayed on a television/online broadcast of a cornhole competition.

Referring now to FIG. 1, an example gaming bag 100 having an onboard flight data collection system 102 in accordance with one non-limiting embodiment is depicted. In the illustrated embodiment, the onboard flight data collection system 102 comprises sensors, a processor, a communication module, an input/output module and power source. As is to be appreciated by those skilled in the art, however, onboard flight data collection systems 102 in accordance with the present disclosure can include a variety of other modules, systems, and so forth, without departing from the scope of the present disclosure. In some embodiments, the components of the onboard flight data collection system can be mounted to one or more circuit boards, which are collectively encased in a rigid enclosure, for example.

The sensors of the onboard flight data collection system 102 can include any type of sensors that can be used to measure certain flight characteristics. In some embodiments, for example, the sensors can provided signals to the processor that are indicative of velocity, acceleration, height, and/or rotation of the gaming bag 100. In some embodiments, the sensors can also measure ambient or environmental data, such as temperature, humidity, barometric pressure, and so forth. In some embodiments, the onboard flight data collection system 102 can include sensors or other components that are configured to interact with, or otherwise communicate with one or more sensors that are coupled to a target.

The communication module can be configured to provide, transmit, or otherwise communicate data from the onboard flight data collection system 102 to a recipient system, such as a computing device. Such data transfer can be via a wireless connection or a wired connection using any type of suitable communication protocol. The data transfer can be in real-time or, in other embodiments, can be a batch download. In one example embodiment, the onboard flight data collection system 102 communicates with a recipient computing device via a short-range wireless technology standard, such as the Bluetooth protocol, but this disclosure is not so limited. The input/output module can receiving inputs from the user and provide outputs (such as lights, sounds, etc.). The power source can be any suitable power source, such as a rechargeable power source or a battery, for example.

In some embodiments, the onboard flight data collection system 102 can be integrated permanently into the gaming bag 100, such that removal of the flight data collection system 102 would cause destruction of the gaming bag 100. In other embodiments, however, the onboard flight data collection system 102 can be selectively coupled to the gaming bag 100, such that it is removable. In this regard, some onboard flight data collection system 102 are installed into the gaming bag 100 at the time the gaming bag 100 is manufactured, while other onboard flight data collection systems 102 can be retrofitted into existing gaming bags.

Figure 2:
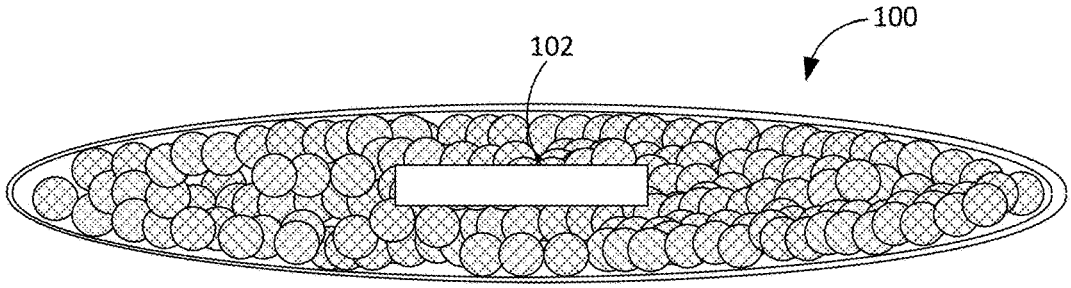
FIGS. 2-5 are cross-sectional views of example gaming bags depicting example placement locations for various types of onboard flight data collection systems.
Figure 3:
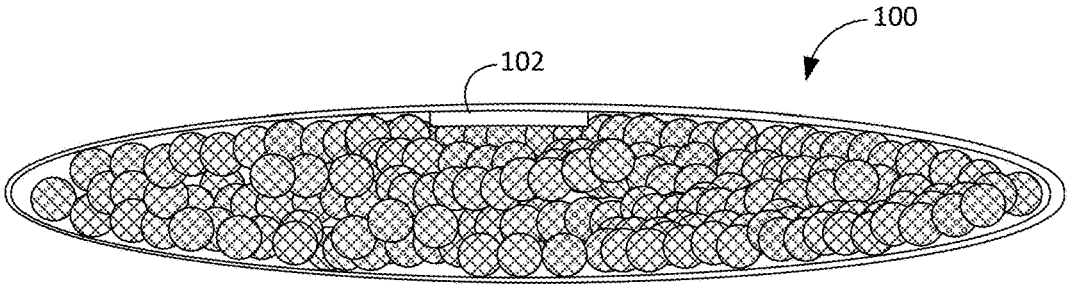
Figure 4:
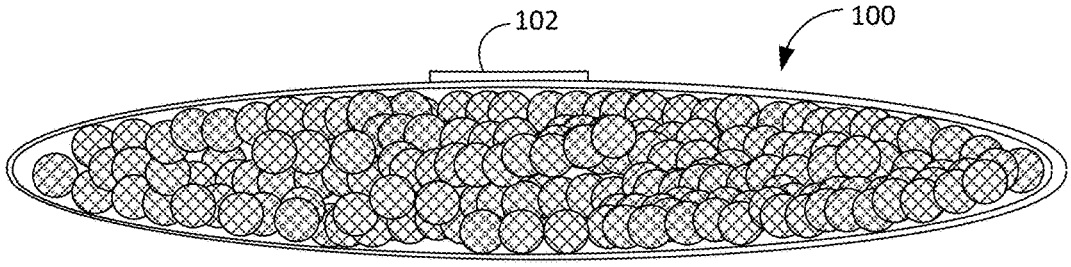
Figure 5:
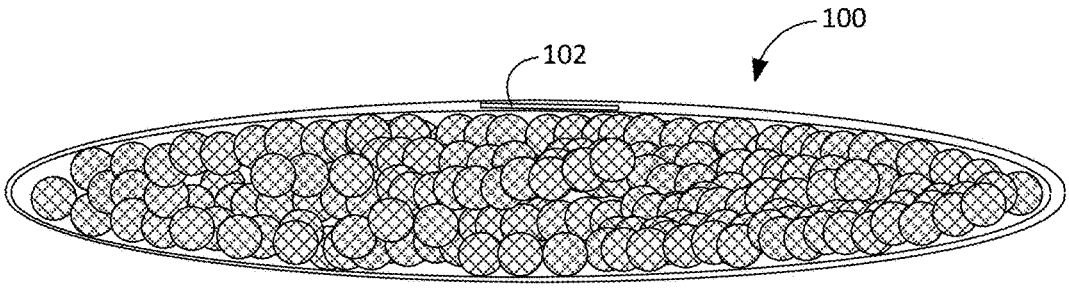

FIGS. 2-5 are cross-sectional views of example gaming bags 100 depicting example placement locations for various types of onboard flight data collection systems 102. Each gaming bag has an outer layer that defines and internal cavity. In many instances, the outer layer is comprised of a top layer and a bottom layer that a stitched together around the periphery to form an internal cavity therebetween. The internal cavity is filled with a filler material, such as polyurethane pellets, synthetic cord pellets, dried corn kernels, dried peas, beans, sand, and so forth. The outer layer is often made from a cotton canvas, microfibers, or combinations thereof. Many gaming bags are about 6 inches square. FIG. 2 depicts the onboard flight data collection system 102 placed internally to the gaming bag 100. The onboard flight data collection system 102 can be "floating" among the filler, or can be tethered or otherwise anchored within the gaming bag 100. FIG. 3 depicts the onboard flight data collection system 102 placed internally to the gaming bag 100 but attached to an inner surface of the gaming bag. The onboard flight data collection system 102 can be attached using any suitable approach, such as hook and loop fasteners, adhesive, snaps, and the like. FIG. 4 depicts the onboard flight data collection system 102 placed externally to the gaming bag 100. The onboard flight data collection system 102 can be attached to the outside of the gaming bag 100 any suitable approach, such as hook and loop fasteners, adhesive, snaps, and the like. FIG. 5 depicts the onboard flight data collection system 102 integrated into the fabric of the gaming bag 100. The size, configuration, and placement of the onboard flight data collection systems 102 can be selected to minimize its effect on the balance, weight, and throwing dynamics of the gaming bag 100. Additionally, in some embodiments, the onboard flight data collection system 102 may include a plurality of different components, which may each be individually coupled to the gaming bag 100 or be generally free-floating within the gaming bag 100. Additionally, while not illustrated in FIG. 2-4, in some embodiments, the onboard flight data collection system 102 can include one or more indicators, such as LEDs, that can illuminate to convey various operational conditions to the user.

Figure 6:
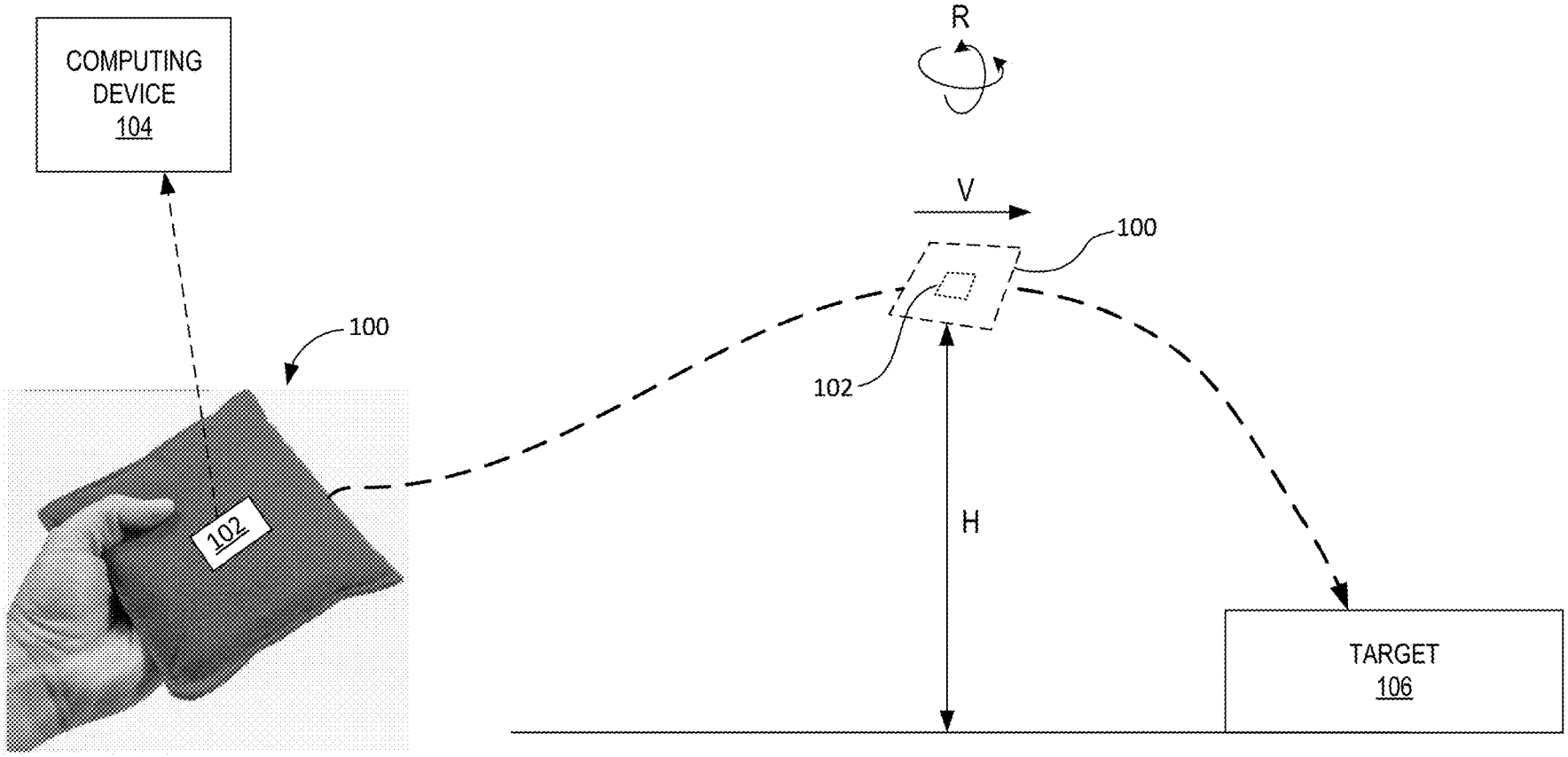
FIG. 6 depicts an example tossing of a gaming bag having an onboard flight data collection system toward a target in accordance with one non-limiting embodiment.

FIG. 6 depicts an example tossing of a gaming bag 100 having an onboard flight data collection system 102 toward a target 106 in accordance with one non-limiting embodiment. The target 106 can be, for example, a cornhole board that is generally rectangular in shape with a raised back end and a hole located proximate the back end. The cornhole board can be connected to a support frame that keeps the surface of the board at a fixed angle.

Figure 7:
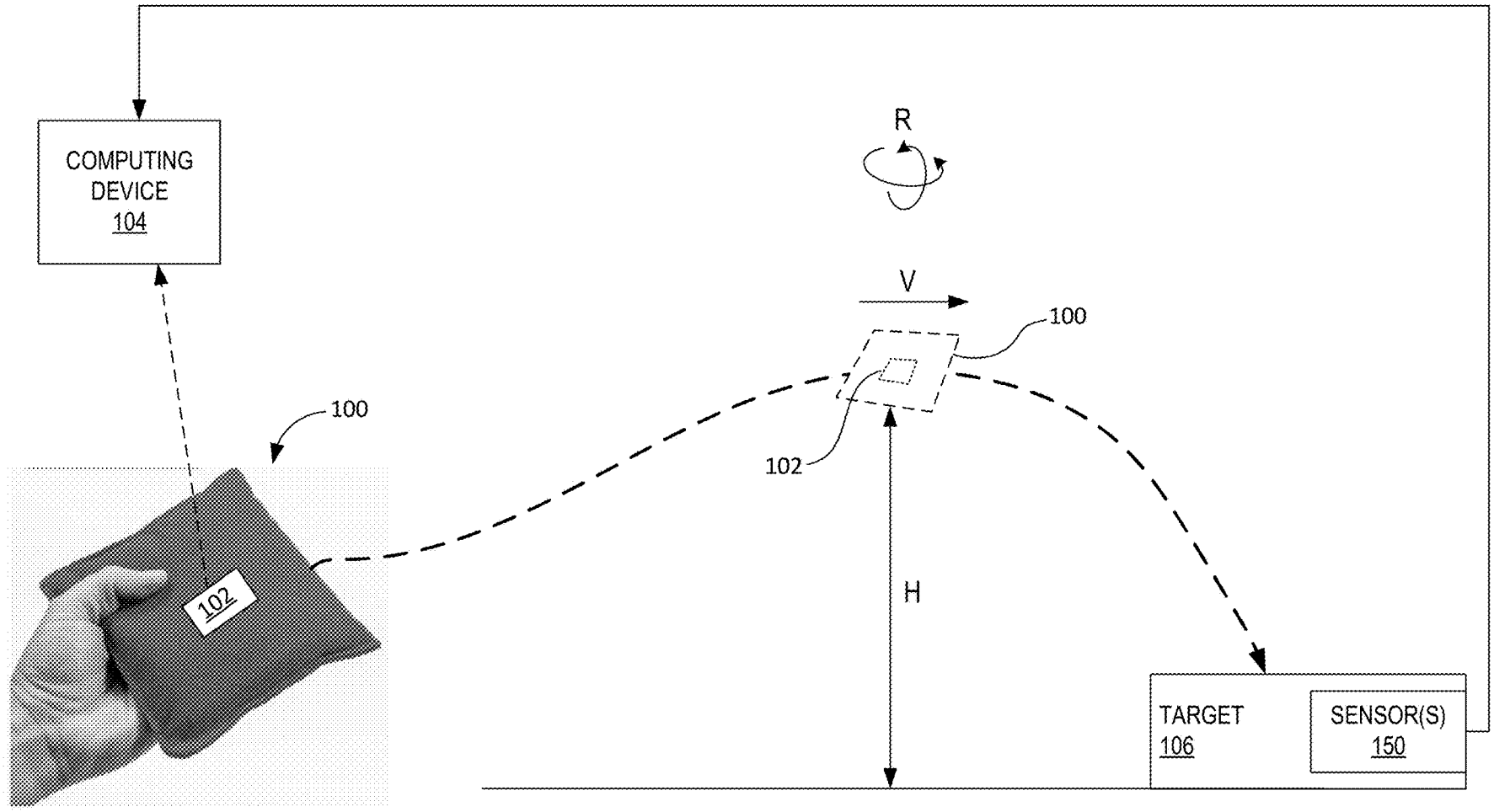
FIG. 7 depicts an example tossing of a gaming bag having an onboard flight data collection system toward a target having one or more sensors in accordance with one non-limiting embodiment.

During flight, the onboard flight data collection system 102 can collect a variety of flight data. While FIG. 6 schematically shows the collection of height, velocity, and rotation, this disclosure is not so limited. Instead, a wide variety of toss data can be collected without departing from the scope of the present disclosure. In any event, the toss data collected by the onboard flight data collection system 102 can be provided to an associated computing device 104. In some embodiments, the toss data is provided to the computing device 104 in real-time via a wireless communication channel between the onboard flight data collection system 102 and the computing device 104. The computing device 104 can be any suitable device, such as a mobile computing device, a laptop computer, a desktop computer, a tablet computer, a video gaming system, a virtual reality system, and so forth. FIG. 7 is similar to FIG. 6, although one or more sensors 150 are shown coupled to the target 106. The sensors 150 can provided data to the computing device 104, or other suitable recipient. The sensors 150 can be used to provide additional toss analytics, such as impact force, impact location, and so forth. Additionally or alternatively, the sensors 150 can be used for automated scorekeeping.

Figure 8:
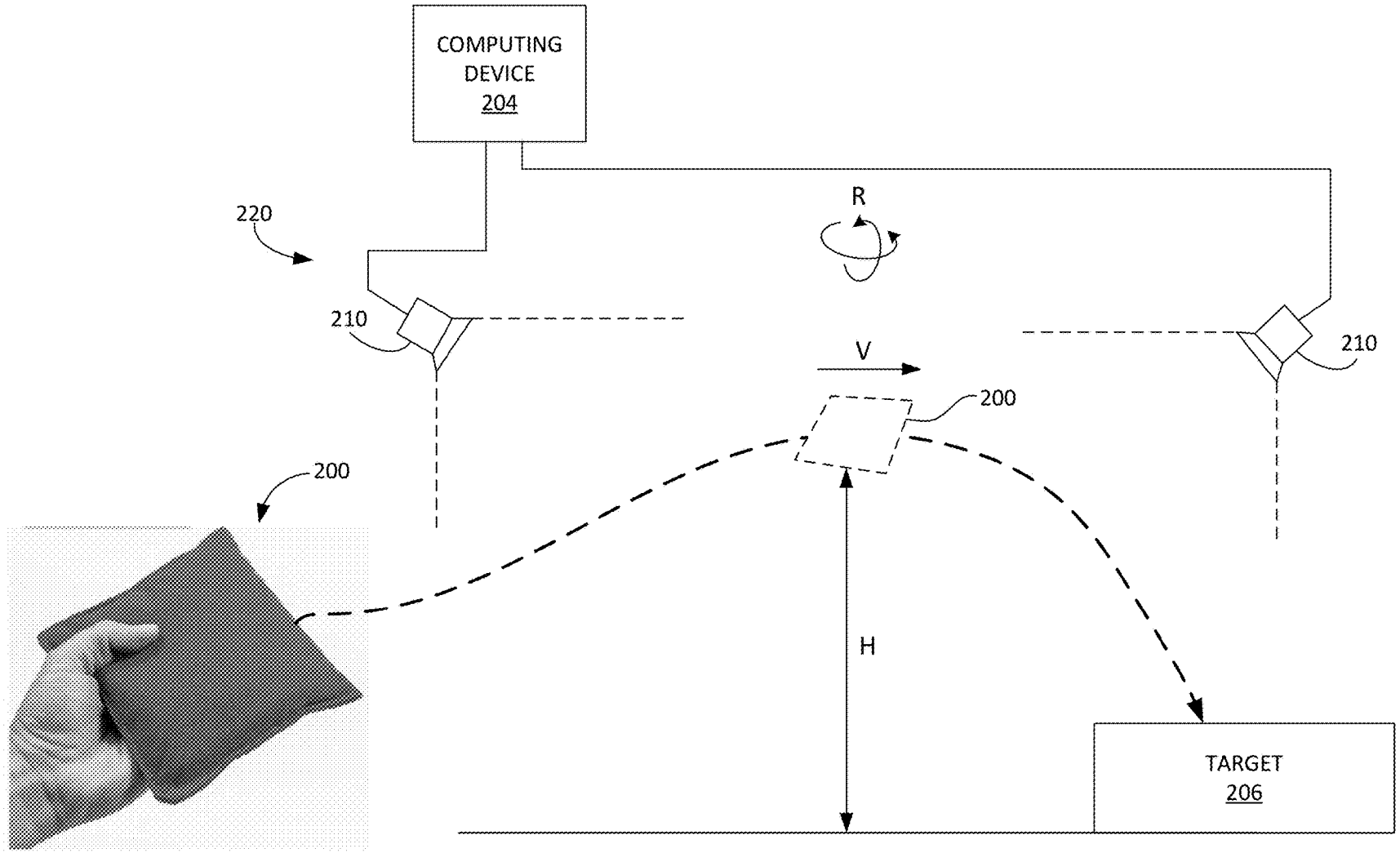
FIG. 8 depicts an example flight data collection system capturing a tossing of a gaming bag toward a target in accordance with one non-limiting embodiment.
Figure 9:
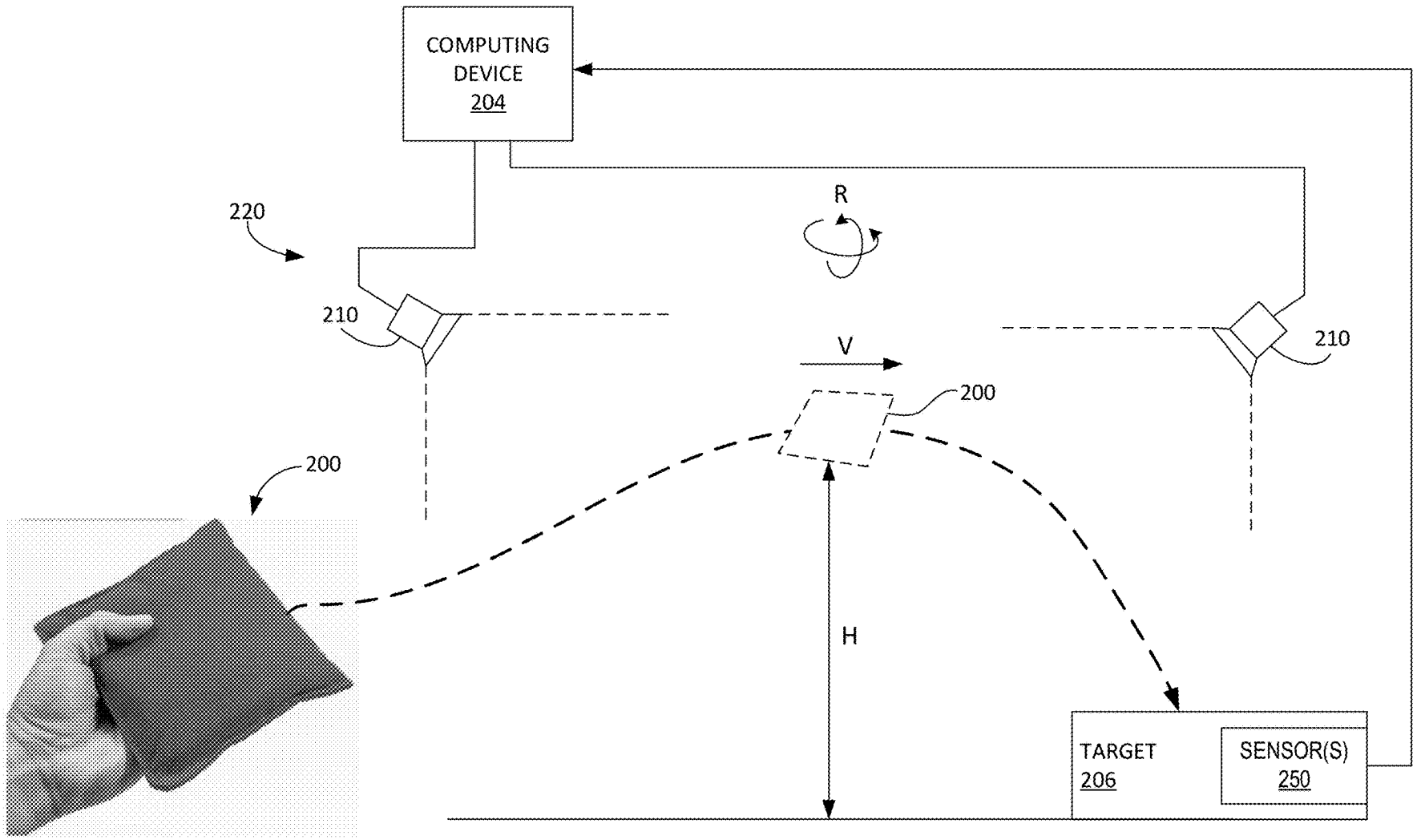
FIG. 9 depicts an example flight data collection system capturing a tossing of a gaming bag toward a target having one or more sensors in accordance with one non-limiting embodiment.

While FIGS. 1-7 depict the use of a flight data collection system that is onboard a gaming bag, this disclosure is not so limited. Referring now to FIG. 8 depicts an example flight data collection system 220 capturing the mechanics of a gaming bag tossed toward a target in accordance with another example non-limiting embodiment. In the example embodiment, the flight data collection system 220 includes one or more cameras 210 that are positioned to capture the flight of the gaming bag 200. The cameras 210 can provide an image feed to a computing device 204 that can process the video to extract toss data, such as height, velocity, rotation, as well as any other analytical information. FIG. 9 is similar to FIG. 8, although one or more sensors 250 are coupled to the target 206. The sensors 250 can provided data to the computing device 204, or other suitable recipient. The sensors 250 can be used to provide additional toss analytics, such as impact force, impact location, and so forth. Additionally or alternatively, the sensors 250 can be used for automated scorekeeping. Moreover, in some embodiments, the computing device can receive data from a combination of cameras and an onboard flight data collection system coupled to the gaming bag.

Figure 10:
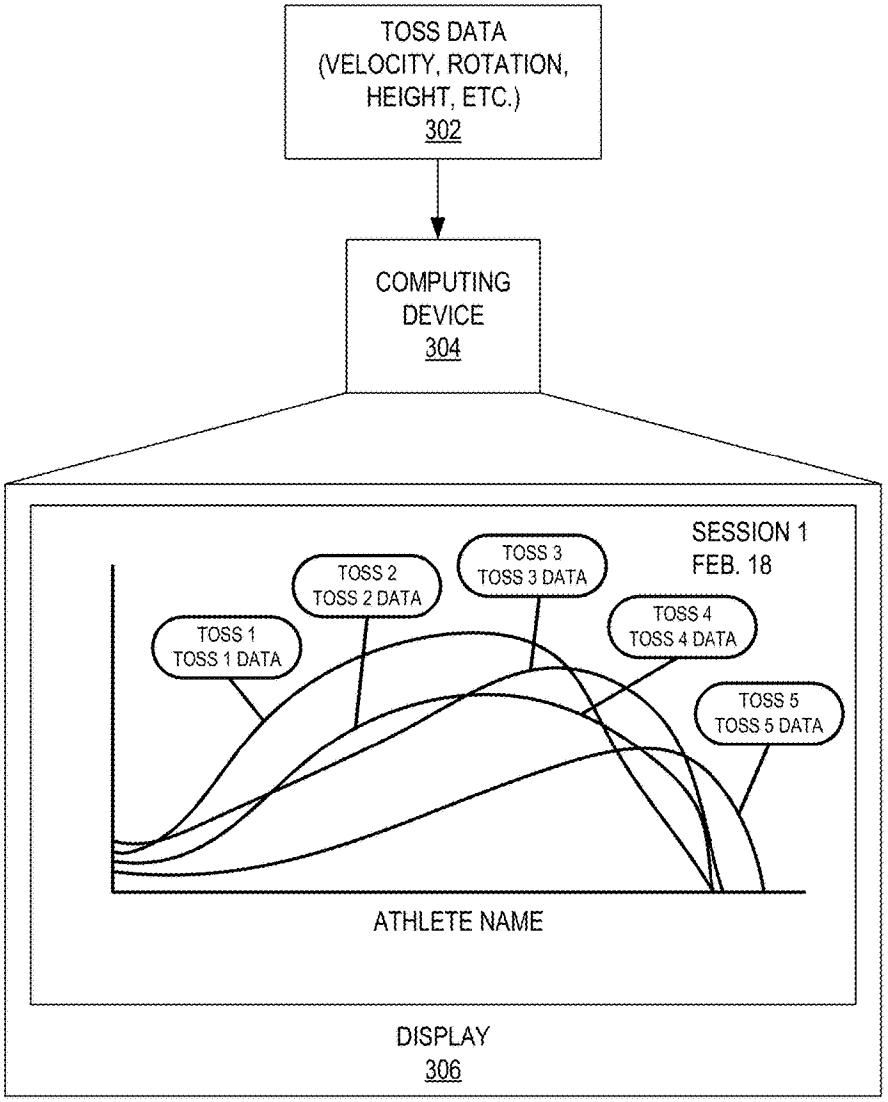
FIG. 10 schematically depicts the display of various toss data on a graphical user interface in accordance with one non-limiting embodiment.

FIG. 10 schematically depicts the simplified display of various toss data on a graphical user interface in accordance with one non-limiting embodiment. As shown, toss data 302 can be provided to a computing device 304. The toss data 302 can be collected by any suitable type of flight data collection system, such as the flight data collection system 102 (FIG. 1), the flight data collection system 220 (FIG. 8), or combinations thereof. A display 306 of the computing device 304 can visually present the toss data in any suitable format. In the illustrated embodiment, the trajectory of a plurality of different tosses, along with the associated toss data, is shown.

As is to be appreciated, the computing device 304 can maintain a repository of tosses for a particular user, which can be used to track the mechanics of user's tosses over time. Additionally, embodiments of the computing device 304 can also be implemented in cloud computing environments. "Cloud computing" may be defined as a model for enabling ubiquitous, convenient, on-demand network access to a shared pool of configurable computing resources (e.g., networks, servers, storage, applications, and services) that can be rapidly provisioned via virtualization and released with minimal management effort or service provider interaction, and then scaled accordingly. A cloud model can be composed of various characteristics (e.g., on-demand self-service, broad network access, resource pooling, rapid elasticity, measured service, etc.), service models (e.g., Software as a Service ("SaaS"), Platform as a Service ("PaaS"), Infrastructure as a Service ("IaaS"), and deployment models (e.g., private cloud, community cloud, public cloud, hybrid cloud, etc.).

Figure 11:
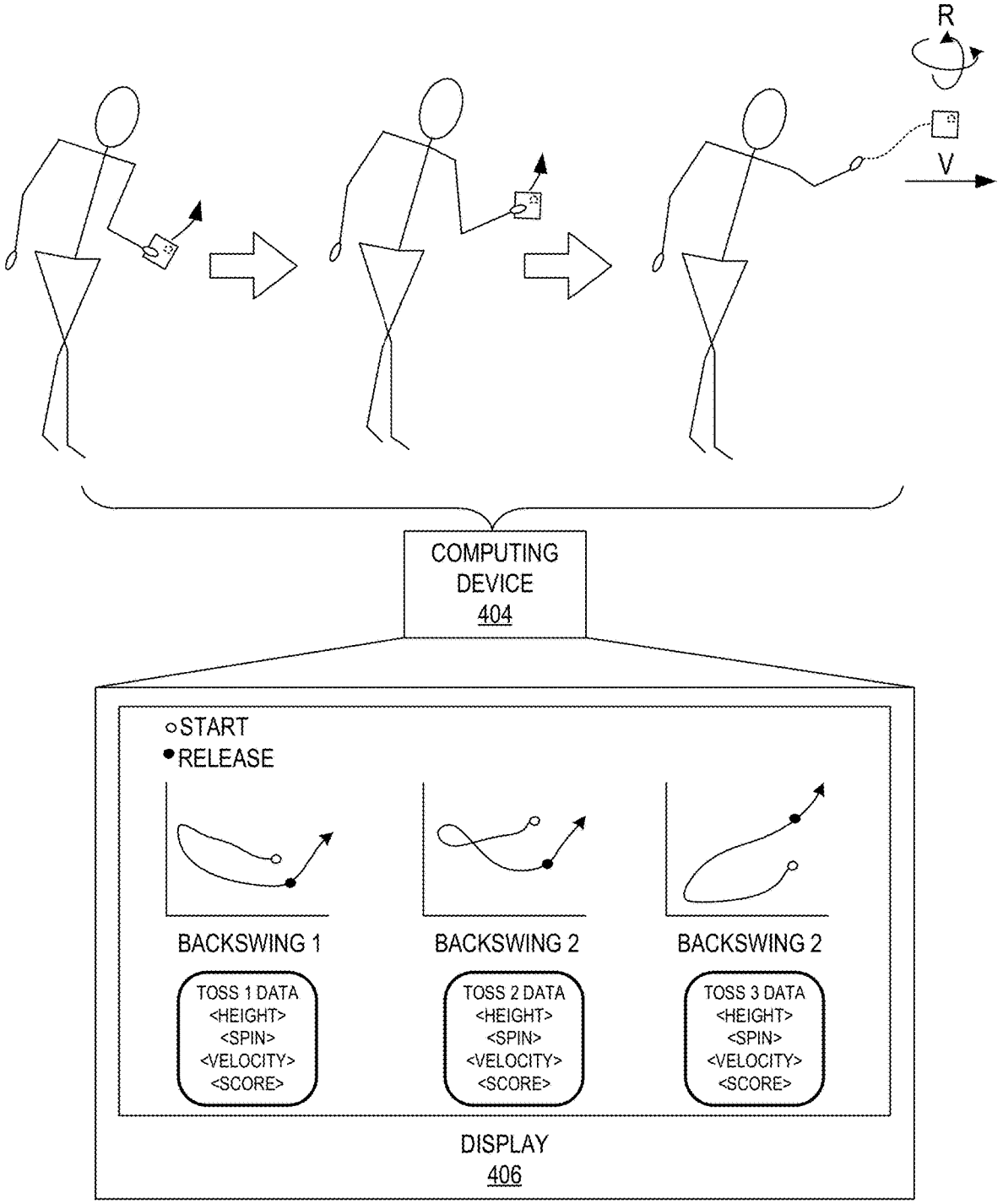
FIG. 11 schematically depicts the display of backswing and toss data on a graphical user interface in accordance with one non-limiting embodiment.

In some embodiments, a player may wish to utilize the system to train for particular types of tosses or otherwise desire feedback regarding the mechanics of their toss. FIG. 11 schematically depicts the display of backswing and toss data on a graphical user interface in accordance with one non-limiting embodiment. In the example simplified display 406, the mechanics of backswings can be tracked, logged, and graphically presented by a computing device 404. Such toss mechanics can be tracked via a flight data collection system (either using onboard sensors or camera(s)), for example, and provided to the computing device 404. While the backswings are schematically shown to be plotted on an X-Y graph in FIG. 11, it is to be appreciated that the mechanics of a backswing can be presented in any suitable format, such as animations, 3-D plots, and so forth. Additional data associated with the toss can also be displayed, as such as height, spin, velocity, and so forth, such that toss characteristics to can be correlated to particular types of backswings.

As with other aspects of the presently disclosed systems and methods, users can receive feedback to help them increase the accuracy of their toss, and in some case, allow them to tune aspects of their tosses. For example, some cornhole players, especially high-level players, often rely on a variety of different types of tosses during a match. Example shot types can include, without limitation, slide shots, push shots, roll shots, blockers, cut shots, bullies, airmail shots, flop shots, and bar of soap shots. The systems and methods described herein can be used by players to better under their tossing techniques, and their technique's impact on the toss, to improve their gameplay.

Figure 12:
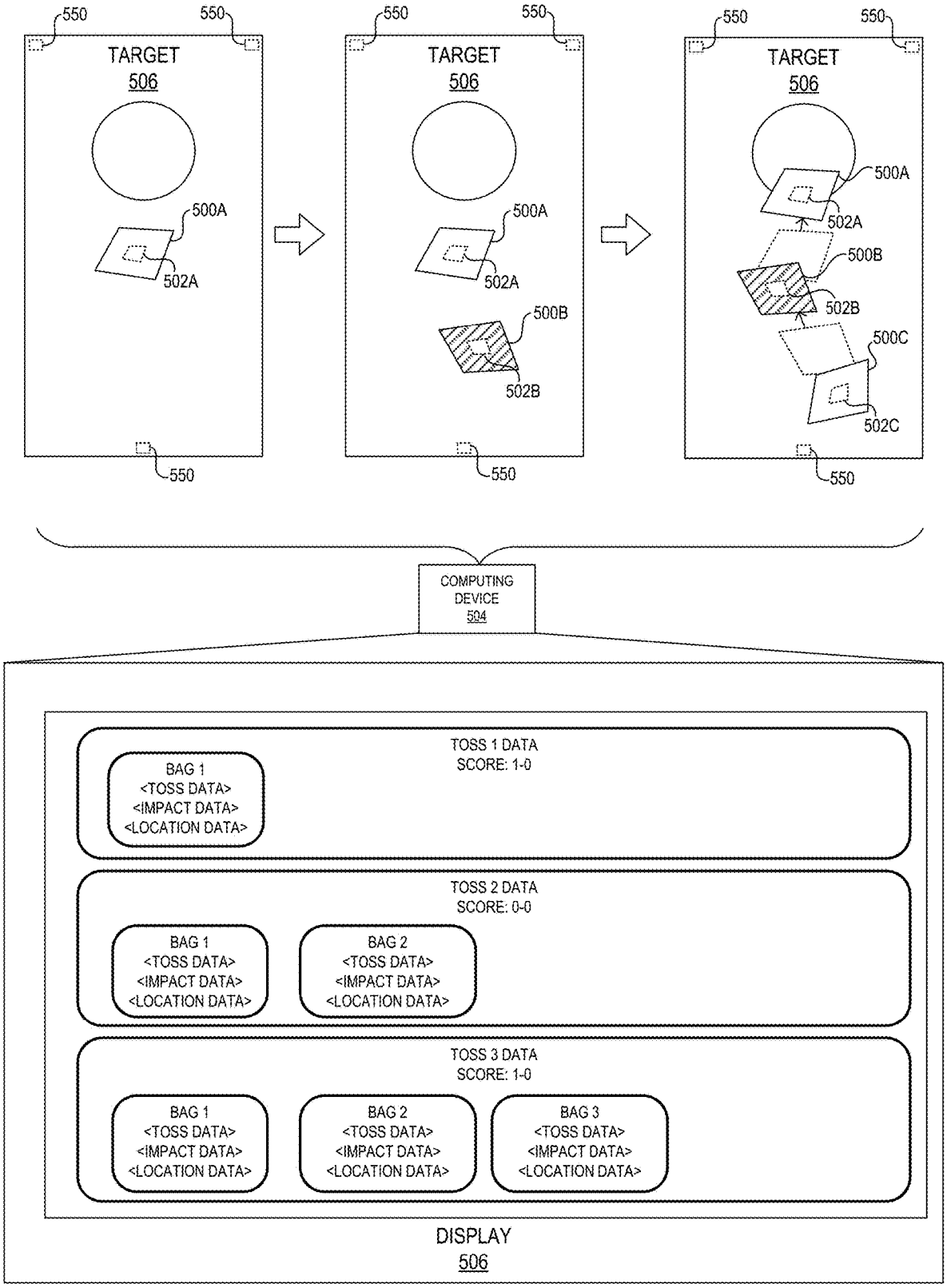
FIG. 12 schematically depicts the display of toss data on a graphical user interface using data collected from a target in accordance with one non-limiting embodiment.

FIG. 12 schematically depicts the display of toss data on a graphical user interface using data collected from a target 506 in accordance with one non-limiting embodiment. In this example embodiment a plurality of sensors 550 are coupled to the target 506. The sensors 550 can be any suitable time of sensor that can provide feedback to a computing device 504, such as location data, scoring data, and so forth. In one example embodiment three sensors 550 are utilized such that the location of a gaming bag on the surface of the target 506 can be triangulated. In other embodiments, cameras, optical sensors, hall-effect sensors, pressure sensors, or other suitable sensors (or combinations thereof) are utilized to provide feedback regarding a tossed gaming bag, as well is its interaction with other gaming bags that may be present on the surface of the target 506. Such system is particular helpful in allowing a user to understand the interaction of gaming bags during impact based on the toss profile of the tossed gaming bag.

FIG. 12 schematically depicts a series of gaming bags 500A-C that are each tossed onto the target 506. In the illustrated embodiment, each gaming bag 500A-C is associated with an onboard flight data collection system 502A-C.

While FIG. 12 depicts the use of onboard flight data collection systems, this disclosure is not so limited. It is to be appreciated additionally or alternatively, a camera-based flight data collection system can be used without departing from the scope of the present disclosure. As shown on the display 506, various data can be displayed for each gaming bag based on the output of the sensors 550 and the output of the onboard flight data collection system 502. Beneficially, as the location of each gaming bag on the surface of the target 506 can be track, the physical interaction between all the gaming bags 500A-C can be quantified and displayed. Referring to FIG. 12, when gaming bag 500C is tossed onto the target 506, its interaction with the gaming bag 500B can be indicated on the display 506 as well as the interaction of gaming back 500B with gaming bag 500A. Thus, the systems and methods described herein can be provide a comprehensive and data-rich view of a variety of different types of tosses in different types of scenarios (i.e., blocking shots, sliding shots, rolling shots, etc.).

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. A gaming bag, comprising:

an outer layer, wherein the outer layer defines an outer facing surface, an inner facing surface, and an internal cavity;

filler material positioned within the internal cavity; and an onboard flight data collection system, wherein the onboard flight data collection system is positioned within the internal cavity, wherein at least a portion of the onboard flight data collection system is coupled to the inner facing surface, and wherein the onboard flight data collection system comprises at least one sensor;

a power supply; and a communication module.

2. The gaming bag of claim 1, wherein the onboard flight data collection system is selectively removable from the internal cavity.

3. The gaming bag of claim 1, wherein the communication module is configured to communicate with a computing device via a short-range wireless technology standard protocol.

4. The gaming bag of claim 3, wherein the communication module is configured to provide velocity data to the computing device.

5. The gaming bag of claim 3, wherein the communication module is configured to provide spin data to the computing device.

6. The gaming bag of claim 3, wherein the communication module is configured to provide height data to the computing device.

7. A system, comprising:

a plurality of gaming bags, wherein each of the plurality of gaming bags comprises an outer layer, wherein the outer later defines an outer facing surface, an inner facing surface, and an internal cavity;

filler material positioned within the internal cavity; and an onboard flight data collection system, wherein the onboard flight data collection system is positioned within the internal cavity, wherein at least a portion of the onboard flight data collection system is coupled to the inner facing surface, wherein the onboard flight data collection system comprises at least one sensor;

a power supply; and a communication module;

a target, wherein the target is rectangular and defines a hole.

8. The system of claim 7, wherein the communication module is configured to communicate with a computing device via a short-range wireless technology standard protocol.

9. The system of claim 8, wherein the target comprises one or more sensors.

10. The system of claim 9, wherein the one or more sensors are configured to communicate with the computing device via a short-range wireless technology standard protocol.

11. A system, comprising:

a plurality of gaming bags, wherein each of the plurality of gaming bags comprises an outer layer, wherein the outer later defines an outer facing surface, an inner facing surface, and an internal cavity;

filler material positioned within the internal cavity; and an onboard flight data collection system, wherein the onboard flight data collection system is positioned within the internal cavity, wherein at least a portion of the onboard flight data collection system is coupled to the inner facing surface, wherein the onboard flight data collection system comprises at least one sensor;

a power supply; and a communication module;

a computing device comprising a graphical display, the computing device executing an application that is configured to receive data from the communication module of the onboard flight data collection system;

display on the graphical display flight data associated with tosses of each of the plurality of gaming bags.

12. The system of claim 11, wherein the flight data comprises spin data.

13. The system of claim 12, wherein the flight data comprises height data.

14. The system of claim 13, wherein the flight data comprises velocity data.

15. The system of claim 11, wherein the flight data comprises backswing data.

16. The system of claim 11, further comprising a target, wherein at least one sensor is coupled to the target, and wherein the computing device is configured to receive data from the at least one sensor.

17. The system of claim 16, wherein the application is configured to display information received from the at least one sensor.

18. The system of claim 11, wherein the communication module is configured to communicate with a computing device via a short-range wireless technology standard protocol.

* * * * *